United States Patent [19]

Sugita et al.

[11] Patent Number: 4,563,222

[45] Date of Patent: Jan. 7, 1986

[54] HIGH STRENGTH BOLT AND METHOD OF PRODUCING SAME

[75] Inventors: Heiji Sugita, Ichikawa; Takehiko Kato, Kobe, both of Japan

[73] Assignee: Sugita Wire Mfg. Co., Ltd., Tokyo, Japan

[21] Appl. No.: 644,158

[22] Filed: Aug. 27, 1984

Related U.S. Application Data

[63] Continuation of Ser. No. 509,046, Jun. 29, 1983, abandoned.

[51] Int. Cl.[4] ..... C21D 1/20

[52] U.S. Cl. ..... 148/12 F

[58] Field of Search ..... 148/12 F, 12 B; 75/123 N

[56] References Cited

U.S. PATENT DOCUMENTS

| | | | |
|---|---|---|---|
| 3,340,102 | 9/1967 | Kulin et al. | 148/12.4 |
| 3,528,088 | 9/1970 | Seghezzi et al. | 148/36 |
| 3,532,560 | 10/1970 | Tomioka et al. | 148/12.4 |
| 3,877,281 | 4/1975 | Shimizu et al. | 148/12 B |
| 4,088,511 | 5/1978 | Rowney | 148/36 |

FOREIGN PATENT DOCUMENTS

| | | | |
|---|---|---|---|
| 21180 | 7/1970 | Japan | 148/36 |
| 72318 | 6/1977 | Japan | 148/143 |
| 51121 | 5/1978 | Japan | 148/12 F |
| 91935 | 7/1980 | Japan | 148/36 |

*Primary Examiner*—Wayland Stallard

*Attorney, Agent, or Firm*—Wegner & Bretschneider

[57] ABSTRACT

A high strength bolt having a as-formed structure and a method of manufacturing the high strength bolt which method comprises the steps of: heating a steel alloy containing 0.15 to 0.3 wt % C and 1 to 3 wt % Mn to a temperature not lower than $Ac_3$ transformation point; subjecting the steel alloy to isothermal transformation at 450° to 580° C.; subjecting, after cooling, the steel alloy to cold wire drawing at a reduction rate not larger than 40%; and bolt forming the steel. A cold wire drawing at a reduction rate not larger than 40% may be carried out before the above-mentioned isothermal transformation step.

2 Claims, 3 Drawing Figures

(B: THE METHOD OF THE PRESENT INVENTION
C: CONVENTIONAL METHOD)

HIGH STRENGTH BOLT AND METHOD OF PRODUCING SAME

This application is a continuation of U.S. application Ser. No. 509,046, filed June 29, 1983, and now abandoned.

BACKGROUND OF THE INVENTION

The present invention relates to a high strength bolt and a method of manufacturing the high strength bolt, and more particularly, to a nonheat-refined high strength bolt excellent in toughness as well as tool life and having a tensile strength not smaller than 80 kg f/mm$^2$ and a method of manufacturing the same which method is characterized by austenitizing a low or medium carbon-manganese steel wire material, and then subjecting the austenitic steel wire material to isothermal transformation, wire drawing and cold forging successively, without quenching and tempering steps.

In general, a high strength bolt having a tensile strength not smaller than 80 kgf/mm$^2$ is manufactured by a method wherein a medium carbon steel wire rod is subjected to spheroidizing annealing and wire drawing, followed by bolt forming by means of cold forging and is then subjected to hardening and tempering, thereby to provide the bolt with a necessary strength and toughness, as shown in U.S. Pat. No. 3,532,560 dated Oct. 6, 1970.

Attention has recently been paid to a method by which a steel product having a high strength and toughness can be manufactured without requiring hardening and tempering after the cold forging, as described in U.S. Pat. No. 3,340,102 dated Sept. 5, 1967. However, this method can not practically apply to the mass production of bolts because of the necessity to effect mechanical deformation at a relatively high temperature range defined by the metastable austenite region of a material to be worked.

SUMMARY OF THE INVENTION

Accordingly, it is a primary object of the invention to obtain a high strength bolt having a "as-forged" structure and a tensile strength not smaller than 80 kgf/mm$^2$ and to provide a method of manufacturing a nonheat-refined high strength bolt equal or higher in quality to or than conventional bolt subjected to hardening and tempering after cold forging, without requiring such hardening and tempering, as well as excellent in life of cold forging tool and having a tensile strength not smaller than 80 kgf/mm$^2$.

Another object of the present invention is to obtain a high strength bolt having superior fatigue strength and being small with respect to variation in mechanical strength, in comparison with these of conventional bolts.

According to the present invention, there is obtained a high strength bolt having a tensile strength not less than 80 kgf/mm$^2$ made of a steel alloy consisting essentially, by weight, of 0.15 to 0.3% C, 1 to 2% Mn and the balance Fe and inevitable impurities, the bolt being provided with a as-forged structure having being superior in fatigue strength and toughness and being small in variation in mechanical strength.

A method of manufacturing a high strength bolt embodying the present invention, comprises the steps of:

heating a steel alloy consisting essentially, by weight, of 0.15 to 0.3% C, 1 to 2% Mn and the balance Fe and inevitable impurities, to a temperature not less than $Ac_3$ transformation point;

subjecting the steel alloy to isothermal transformation at 450° to 580° C.;

subjecting, after cooling, the steel alloy to cold wire drawing at a reduction ratio not more than 40%; and bolt-forming the steel alloy.

In the case of the method of the present invention, the life of tools used therein is substantially equal to that of convention bolt producing methods in which hardening and tempering are effected.

Moreover, according to another aspect of the invention, there is provided a method of manufacturing a high strength bolt, comprising the steps of: subjecting a steel containing 0.15 to 0.3 wt % C and 1 to 2 wt % Mn to cold wire drawing at a reduction rate not larger than 40%; heating the steel to a temperature not lower than $Ac_3$ transformation point; subjecting the steel to isothermal transformation at 450° to 580° C.; subjecting, after cooling, the steel to cold wire drawing at a reduction rate not larger than 40%; and bolt-forming the steel.

The high strength bolt and the method for producing the same in accordance with the invention will be described hereinbelow in detail.

First of all, the reason that a steel containing 0.15 to 0.3 wt % C and 1 to 2 wt % Mn is most suitable for manufacturing a high strength bolt will be explained hereinbelow through the components and the component ratio thereof.

Carbon is essential for increasing the strength of the steel. A carbon content less than 0.15 wt % is not effective in increasing the strength, while a carbon content in excess of 0.3 wt % lowers the toughness of the steel, causing cold forging formability and tool life to be remarkably lowered. Therefore, the C content is limited to fall between 0.15 and 0.3 wt %.

Mn is an element which strengthens the steel by existing in a ferrite in a solid solution state, but an Mn content less than 1 wt % is not sufficient for ensuring the strength. The reason that Mn is contained in order to ensure the strength is as follows. Namely, the lowering of toughness caused by containing Mn for strengthening is smaller than that caused by containing other elements, such as C or Si. In addition, Mn is smaller than C or Si in the rate of damaging the cold forging formability. Moreover, an Mn content in excess of 2 wt % reduces the toughness improving effect and damages the cold forging formability as well as gives a rise in the production cost. Accordingly, the Mn content is limited to fall between 1 and 2 wt %.

Besides C and Mn, Si is essential for refining the steel. An Si content up to 0.5 wt % is allowable. Moreover, as alloy components the following elements may be contained according to circumstances: Ni of not larger than 1 wt %; Cr of not larger than 1 wt %; Mo of not larger than 0.5 wt %; Al of not larger than 0.1 wt %; Ti of not larger than 0.1 wt %; B of not larger than 0.005 wt %; and so forth.

In the method of manufacturing a high strength bolt in accordance with the invention, the following steps are indispensable for obtaining a nonheat refined high strength bolt excellent in toughness as well as cold forging formability and having a tensile strength not smaller than 80 kgf/mm$^2$: namely, heating a steel having the components and the component ratio such as described above to a temperature not lower than $Ac_3$ transformation point; subjecting the heated steel to isothermal transformation in lead bath or salt bath of 450° to 580° C.; and subjecting the treated steel to cold wire drawing and cold forging.

More specifically, if the above-described steel is heated to a temperature not lower than $Ac_3$ transformation point and then subjected to isothermal transformation at a temperature ranging between 450° and 580° C., the structure of the steel is transformed into a fine structure having bainite, thereby allowing the steel to improve in elongation and drawing. In the above-mentioned temperature range, a temperature ranging between 550° and 570° C. is preferable to obtain a fine structure having bainite. The steel having been subjected to the isothermal transformation is improved in toughness but is unsatisfactory in strength, i.e., the steel has a tensile strength not satisfying the condition of not smaller than 80 kgf/mm$^2$. Therefore, the transformed steel is subjected to cold wire drawing for obtaining desired mechanical properties and for sizing. In this case, a reduction rate less than 15% is insufficient for ensuring a tensile strength not smaller than 80 kgf/mm$^2$, so that a desired strength cannot be obtained. On the other hand, a reduction rate exceeding 40% deteriorates the toughness unfavorably. Therefore, it is preferable to select the reduction rate to be 15%–40%.

By bolt-forming the drawn wire material by means of cold forging, a bolt high in strength and toughness can be obtained.

The steel having the above-described components and component ratio may be used as it is cold-forging. However, after the steel has been heated to a temperature not lower than $Ac_3$ transformation point and before the heated steel is subjected to isothermal transformation, if the heated steel is subjected to cold wire drawing at a reduction rate not larger than 40% so as to cause dislocations into the structure, the dislocation becomes an austenitic core in the subsequent step of austenitizing the drawn steel to allow the austenitic grains to be finer than those of the steel not subjected to cold wire drawing. Therefore, a much finer transformed structure can be obtained in the subsequent isothermal transformation treatment. As a result, the steel is improved in toughness more than the steel not subjected to cold wire drawing. It is desirable that the reduction rate in such a case should be not larger than 40% so that the drawing can be completed by one pass, and the steel should be wire-drawn at a reduction rate not smaller than 10% for making the grains finer.

In general, a high strength bolt is hardly used as it has been subjected to hardening and tempering after cold forging, and in most cases the bolt is subjected to plating before being used. In such a case, the bolt is subjected to baking for about four hours at 190° C. for dehydrogenation. However, in the case of the bolt obtained by the method of manufacturing a high strength bolt in accordance with the invention, if the bolt is subjected to plating after cold forging and is then subjected to stress relief annealing for not less than 30 minutes at 200° to 400° C. instead of baking, then, it is possible to effect dehydrogenation as well as to obtain a yield ratio of 88 to 90%, which is substantially equal to that of the conventional bolt subjected to hardening and tempering after cold forging, while the permanent elongation is improved in the case of the present invention.

The invention will be more easily understood from the following description taken in connection with the accompanying drawing.

DESCRIPTION OF PREFERRED EMBDOIMENT

Figure 1:
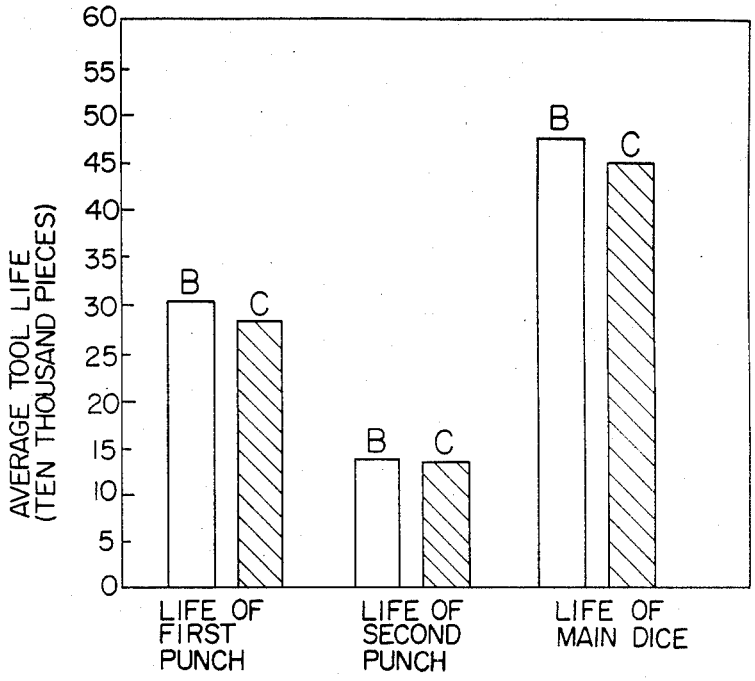
FIG. 1 is a graph showing the tool life (A) in the case of a bolt formed by the method of manufacturing a high strength bolt in accordance with the invention and the tool life (B) in the case of a bolt for comparison formed by the conventional method.

Examples of high strength bolts and method for manufacturing the same in accordance with the present invention will be described hereinbelow in comparison with an example of the conventional ones.

EXAMPLES

For each of test steels having components and component ratios shown in Table 1, an upset head bolt having nominal thread diameter of 10 mm was produced according to the following manufacturing steps.

TABLE 1

| Sample | (wt %) | | | | | | |
|---|---|---|---|---|---|---|---|
| No. | C | Si | Mn | P | S | | Ni |
| A | 0.23 | 0.24 | 1.38 | 0.018 | 0.014 | 0.02 | 0.02 |
| B | 0.24 | 0.20 | 1.44 | 0.015 | 0.017 | 0.02 | 0.03 |
| C | 0.42 | 0.20 | 0.75 | 0.013 | 0.012 | 0.03 | 0.03 |

(Manufacturing Steps)

(1) A method of manufacturing a high strength bolt in accordance with the invention: hot rolling into a material having a diameter of 11.0 mm→reheating (950° C. for 6 minutes)→inserting in lead bath (or salt bath) (560° C. for 5 minutes) and air cooling→cold wire drawing (32% in reduction of area)→cold forming (nominal thread diameter of 10 mm and pitches of 1.25 mm, upset head bolt)→zinc-chromate plating→stress relief annealing (200° C. for 4 hours).

(2) A method of manufacturing a high strength bolt is accordance with the invention: hot rolling into a material having a diameter of 13.0 mm→cold wire drawing (28% in reduction of area)→reheating (950° C. for 6 minutes)→inserting into lead bath (560° C. for 5 minutes)→cold wire drawing (32% in reduction of area)→cold forging (nominal thread diameter of 10 mm and pitches of 1.25 mm, upset head bolt)→zinc chromate plating→stress relief annealing (200° C. for 4 hours).

(3) A conventional method: hot rolling into a material having a diameter of 10.3 mm→spheroidizing annealing→cold wire drawing (22% in reduction of area)→cold forging (nominal thread diameter of 10 mm and pitches of 1.25 mm, head bolt)→hardening and tempering (850° C. for 30 minutes→O.Q., 570° C. for 60 minutes→A.C.)→zinc chromate plating→baking (190° C. for 4 hours).

Various properties of the high strength bolts produced according to the above described manufacturing steps are shown in Table 2. In addition, the tool life in the case of each of the bolts is shown in FIG. 1.

TABLE 2

| | Manufacturing step No. | Mechanical properties (JIS14A) Yield point (0.2%) (kgf/mm²) | Tensile strength (kgf/cm²) | Elongation (%) | Reduction of area (%) | Strength of finished products (kgf/cm²) | Permanent elongation (μm) | Charpty impact strength (kg-m/cm²) at ordinary temp. |
|---|---|---|---|---|---|---|---|---|
| A Method of present invention (Sample No. A) | (1) | 82.0 | 88.2 | 18.8 | 63.5 | 90.5 | 2.0 | 17.0 |
| B Method of present invention (Sample No. B) | (2) | 85.4 | 88.6 | 19.8 | 66.7 | 90.2 | 1.0 | 18.2 |
| C Conventional method (Sample No. C) | (3) | 79.3 | 88.0 | 19.2 | 59.3 | 88.7 | 2.0 | 14.8 |

As will be clear from Table 2, according to the method of manufacturing a high strength bolt in accordance with the invention, it is possible to obtain a bolt equal or higher in quality to or than the bolt formed by the conventional method, without requiring hardening and tempering, and particularly excellent in impact resistance value.

Next, as will be apparent from FIG. 1, it can be said that the tool life in the case of the bolt formed by the method B of manufacturing a high strength bolt in accordance with the invention is substantially equal to that in the case of the bolt formed by the conventional method C. More specifically, if isothermal transformation treatment is carried out instead of spheroidizing annealing, a bolt having an excellent toughness can be obtained without effecting hardening and tempering. Moreover, as mentioned above, the method of manufacturing a high strength bolt in accordance with the invention is substantially equal in tool life to the conventional method, and the step of spheroidizing annealing and the step of isothermal transformation are regarded as corresponding to each other. Also, the step of baking and the step of stress relief annealing are regarded as corresponding to each other. In addition, the method of manufacturing a high strength bolt in accordance with the invention can omit hardening and tempering. Therefore, the method of the invention advantageously makes it possible to save energy and reduce the production cost through omission of manufacturing steps.

Figure 2:
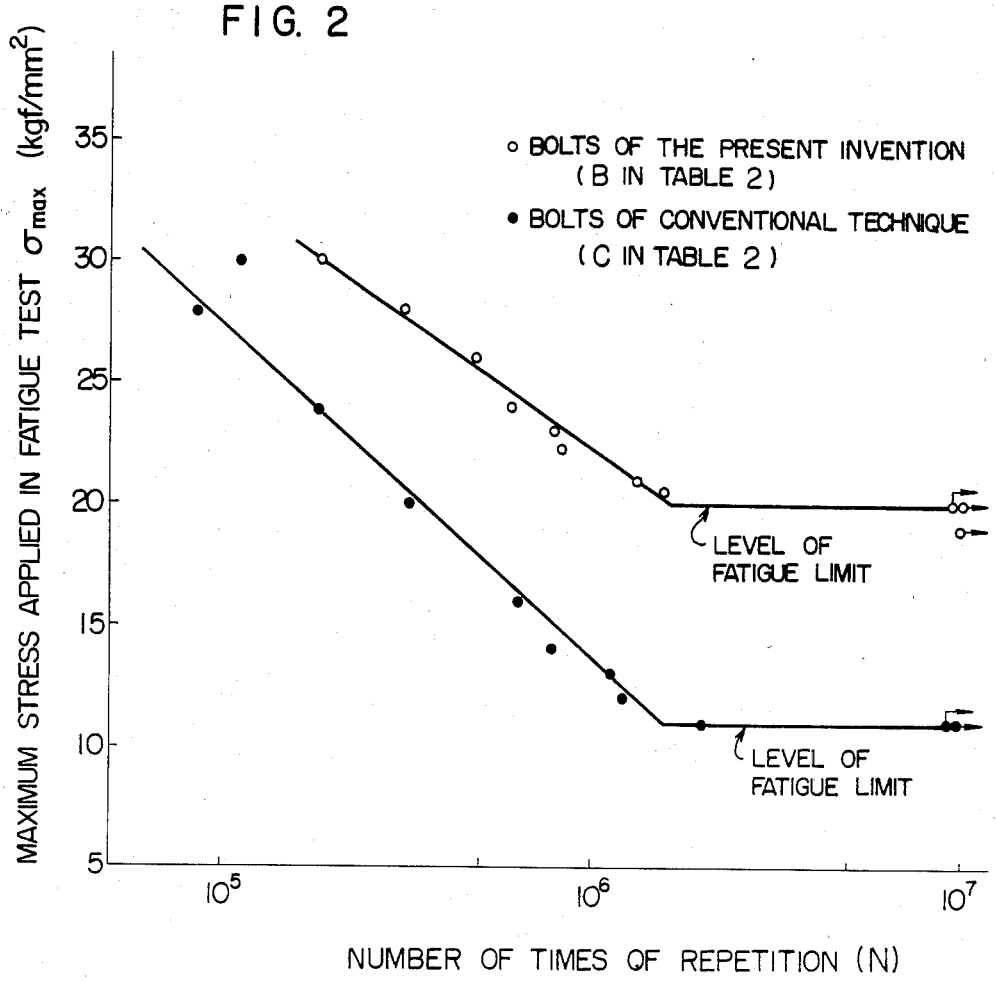
FIG. 2 is a graph showing the values of fatigue strength of bolts embodying the present invention in comparison with the fatigue strength of conventional technique.
Figure 3:
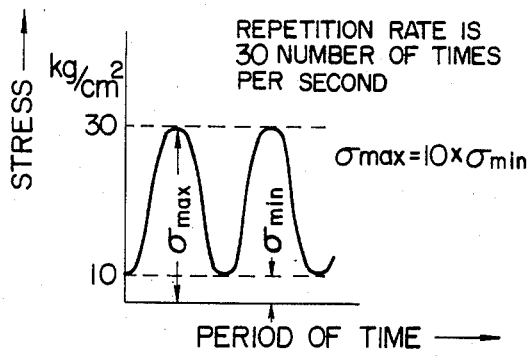
FIG. 3 is a graph showing the manner of fatigue test effected to obtain the values shown in FIG. 2.

FIG. 2 shows the superior fatigue limit of the bolts embodying the present invention in comparison with conventional bolts, that is, the bolts of the present invention have fatigue limit larger about 100% than that of conventional bolts when compared by use of Bordwin type Fatigue test Machine in which each of test pieces is subjected to the repetition of a cycle of the maximum stress $\sigma_{max}$ and the minimum stress $\sigma_{min}$ of one-tenth of $\sigma_{max}$ as shown in FIG. 3.

In addition, since in the present invention there is no step of hardening treatment, the variation in resultant mechanical strength of bolt products of the present invention becomes within a range of 5 kgf/mm² in the case of tensile strength which is very small in comparison with the variation range of 10–15 kgf/mm² in tensile strength in the case of the conventional bolts.

Further, in the present invention, there is no fear of any bend of the bolt due to hardening which is often found in a conventional long bolt produced by the conventional process.

What is claimed is:

1. A method of manufacturing a bolt, having higher impact resistance and superior fatigue strength, comprising the steps of:

heating a steel alloy consisting essentially of 0.15 to 0.3 wt % C, 1 to 2 wt % Mn and the balance Fe and inevitable impurities, to a temperature not lower than $Ac_3$ transformation point of the alloy to produce solely an austenite phase in the alloy;

inserting said heated steel alloy into means for isothermal heat-treatment directly after heating, to subject said steel alloy to isothermal transformation at 450° to 580° C.;

subjecting, after cooling, said steel alloy to cold wire drawing at a reduction rate in the range of 15% to 40%; and cold-forging said steel alloy into a bolt so that the impact resistance of the thus formed bolt is not less than 17 kg-m/cm².

2. A method of manufacturing a bolt, having high impact resistance and superior fatigue strength, comprising the steps of:

subjecting a steel alloy consisting essentially of 0.15 to 0.3 wt % C, 1 to 2 wt % Mn and the balance Fe and inevitable impurities to cold wire drawing at a reduction rate not larger than 40%;

heating said steel alloy to a temperature not lower than the $Ac_3$ transformation point of the alloy to produce solely an austenite phase in the alloy;

inserting said heated steel alloy into means for isothermal heat-treatment directly after heating, to subject said steel alloy to isothermal transformation at 450° to 580° C.;

subjecting, after cooling, said steel alloy to cold wire drawing at a reduction rate in the range of 15% to 40%; and cold-forging said steel alloy into a bolt so that the impact resistance of the thus formed bolt is not less than 17 kg-m/cm².

* * * * *